US008038135B2

(12) United States Patent
Phillips, Sr. et al.

(10) Patent No.: US 8,038,135 B2
(45) Date of Patent: Oct. 18, 2011

(54) CLAMP ASSEMBLY FOR SLIDING CLAMP

(75) Inventors: Charles M. Phillips, Sr., Zelienople, PA (US); Mark P. Noah, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 702 days.

(21) Appl. No.: 12/116,353

(22) Filed: May 7, 2008

(65) Prior Publication Data

US 2008/0277849 A1 Nov. 13, 2008

Related U.S. Application Data

(60) Provisional application No. 60/916,409, filed on May 7, 2007.

(51) Int. Cl.
*B25B 1/00* (2006.01)

(52) U.S. Cl. ..... 269/6; 269/1; 269/3

(58) Field of Classification Search ..... 269/1, 3, 269/6

See application file for complete search history.

(56) References Cited

U.S. PATENT DOCUMENTS

| | | | | |
|---|---|---|---|---|
| 2,503,373 | A * | 4/1950 | Browning et al. | 81/177.7 |
| 5,692,734 | A | 12/1997 | Aldredge, Sr. | |
| 6,648,314 | B1 * | 11/2003 | Degen et al. | 269/6 |
| 7,530,556 | B1 * | 5/2009 | Zheng | 269/6 |

* cited by examiner

*Primary Examiner* — Joseph J Hail
*Assistant Examiner* — Shantese McDonald
(74) *Attorney, Agent, or Firm* — Eckert Seamans Cherin & Mellott, LLC; David C. Jenkins, Esquire; Grant E. Coffield, Esquire

(57) ABSTRACT

A sliding clamp and clamp assembly are provided. The clamp assembly includes a cam member that, when actuated, biases a stationary clamp jaw assembly toward another jaw assembly. The cam member utilizes a ball-and-socket coupling to couple the cam member to the sliding clamp bar. The ball-and-socket coupling allows the cam member, and an extended actuator, to be pivoted and rotated into an infinite number of positions.

16 Claims, 6 Drawing Sheets

CLAMP ASSEMBLY FOR SLIDING CLAMP

CROSS REFERENCE TO RELATED APPLICATION

This application claims priority under 35 U.S.C. §119(e) to U.S. Provisional Patent Application Ser. No. 60/916,409, filed May 7, 2007 entitled, CLAMP ASSEMBLY FOR SLIDING CLAMP.

BACKGROUND OF THE INVENTION

1. Field of the Invention

This invention relates to a sliding clamp and, more specifically, to an improved clamping assembly for a sliding clamp.

2. Background Information

As shown in FIGS. 1 and 2, a sliding clamp typically includes an elongated bar 1, a stationary jaw assembly 2, and a clamp assembly 3. The sliding clamp further includes a sliding jaw (not shown). The two jaw assemblies are coupled to the bar 1. The sliding jaw assembly is structured to slide over, essentially, the length of the bar. The sliding jaw assembly includes a locking assembly structured to limit the direction of travel of the sliding jaw assembly. That is, when the locking assembly is engaged, the sliding jaw assembly may not be moved away from the stationary jaw assembly 2. The stationary jaw assembly 2 does not travel over the length of the bar 1 but may be moved a short distance longitudinally along the bar 1. The stationary jaw assembly 2 includes a cam follower 4. The stationary jaw assembly moves in response to actuation of the clamp assembly 3. It is noted that the word "stationary" is not used in a strict sense, but rather indicates that the stationary jaw assembly's 1 range of motion is very limited relative to the sliding jaw assembly.

The clamp assembly 3 is coupled to the bar and includes a cam member 5 and a cam actuator 6. The cam member 5 has, generally, a flat body with a pivot point 7, a first flat side 8, a second flat side 9, and a transition between the flat sides. The first flat side 8 is located closer to the pivot point 7 than the second flat side 9. The cam member 5 is coupled to the bar at the pivot point 7. Thus, the cam member 5 is structured to pivot relative to the bar 1 between a first position and a second position. In the first position, the first flat side 8 is adjacent to, and engages, the stationary jaw assembly cam follower 4. In the second position, the second flat side 9 is adjacent to, and engages, the stationary jaw assembly cam follower 4. Because the second flat side 9 is disposed further from the pivot point 7 than the first flat side 8, when the cam member 5 is in the second position, the stationary jaw assembly 2 is shifted longitudinally toward the sliding jaw assembly. Further, because the cam flat sides 8, 9 engage a flat surface on the stationary jaw assembly 2, the cam member 5 tends not to rotate without actuation. The cam member 5 is actuated by the cam actuator 6 which is, typically, an elongated handle.

In use, the sliding jaw assembly is initially spaced from the stationary jaw assembly 2 and the clamp assembly cam member 5 is in the first position. A user places the object(s) to be clamped between separated jaw assemblies and in contact with the stationary jaw assembly 1. The user slides the sliding jaw assembly against the object and engages the locking assembly. Thus, at this point, the object is loosely held between the jaw assemblies. That is, while the jaws, which have been biased against the object with manual force, may hold the object, the object is not securely clamped between the jaws. When the user actuates the clamp assembly 3, the stationary jaw assembly 2 shifts toward the sliding jaw assembly thereby securely clamping the object between the jaws with a mechanical force.

The disadvantage to this configuration is that the cam member 5 and the cam actuator 6 pivot about a stationary axis. That is, the cam member 5 and the cam actuator 6 are coupled to the bar 1 by a pivot coupling that is, typically, an opening in the bar 1 and a rod extending therethough. Thus, the cam member 5 and the cam actuator 6 may only pivot about this stationary axis. This is a disadvantage as the cam actuator 6 may not be rotated away from external obstacles or may interfere with work being performed on the clamped object.

SUMMARY OF THE INVENTION

A clamp assembly is provided which includes a cam and cam actuator that are coupled to the bar by a ball-and-socket assembly; that is, rather than a pivot with a fixed axis, the rod has a ball fixed thereto adjacent the stationary jaw assembly. The cam is now a generally cylindrical member having a ball-shaped socket, a slot, a first flat surface, a second flat surface, and an actuator coupling. The ball-shaped socket is sized to correspond to the ball on the rod. The first flat surface is, preferably, a first axial surface. The second flat surface is, preferably, a portion of the cylindrical member sidewall. The first flat surface is closer to the center of the socket than the second flat surface. A transition surface, which is preferably an acute curve, extends between the first flat surface and the second flat surface. The slot bifurcates the first flat surface, the transition surface, and the second flat surface. The cam actuator, which is preferably an elongated handle, is coupled to a second axial surface that is opposite the first axial surface.

In this configuration, the cam member is coupled to the bar by the ball-and-socket coupling. The bar extends through the slot. The cam member is structured to pivot relative to the bar between a first position and a second position. In the first position, the first flat side is adjacent to, and engages, the stationary jaw assembly cam follower. In the second position, the second flat side is adjacent to, and engages, the stationary jaw assembly cam follower. Because the second flat side is disposed further from the pivot than the first flat side, when the cam is in the second position, the stationary jaw assembly is shifted longitudinally along the bar toward the sliding jaw assembly. Further, because the cam flat sides engage a flat surface on the stationary jaw assembly, the cam tends not to rotate without actuation.

Unlike the prior art, the cam member is coupled to the bar via a ball-and-socket coupling; therefore, the cam member and the cam actuator are free to rotate about the ball. Thus, a user may rotate the cam actuator to different orientations that may allow more convenient access to the clamped object.

BRIEF DESCRIPTION OF THE DRAWINGS

A full understanding of the invention can be gained from the following description of the preferred embodiments when read in conjunction with the accompanying drawings in which.

DETAILED DESCRIPTION

Figure 1:
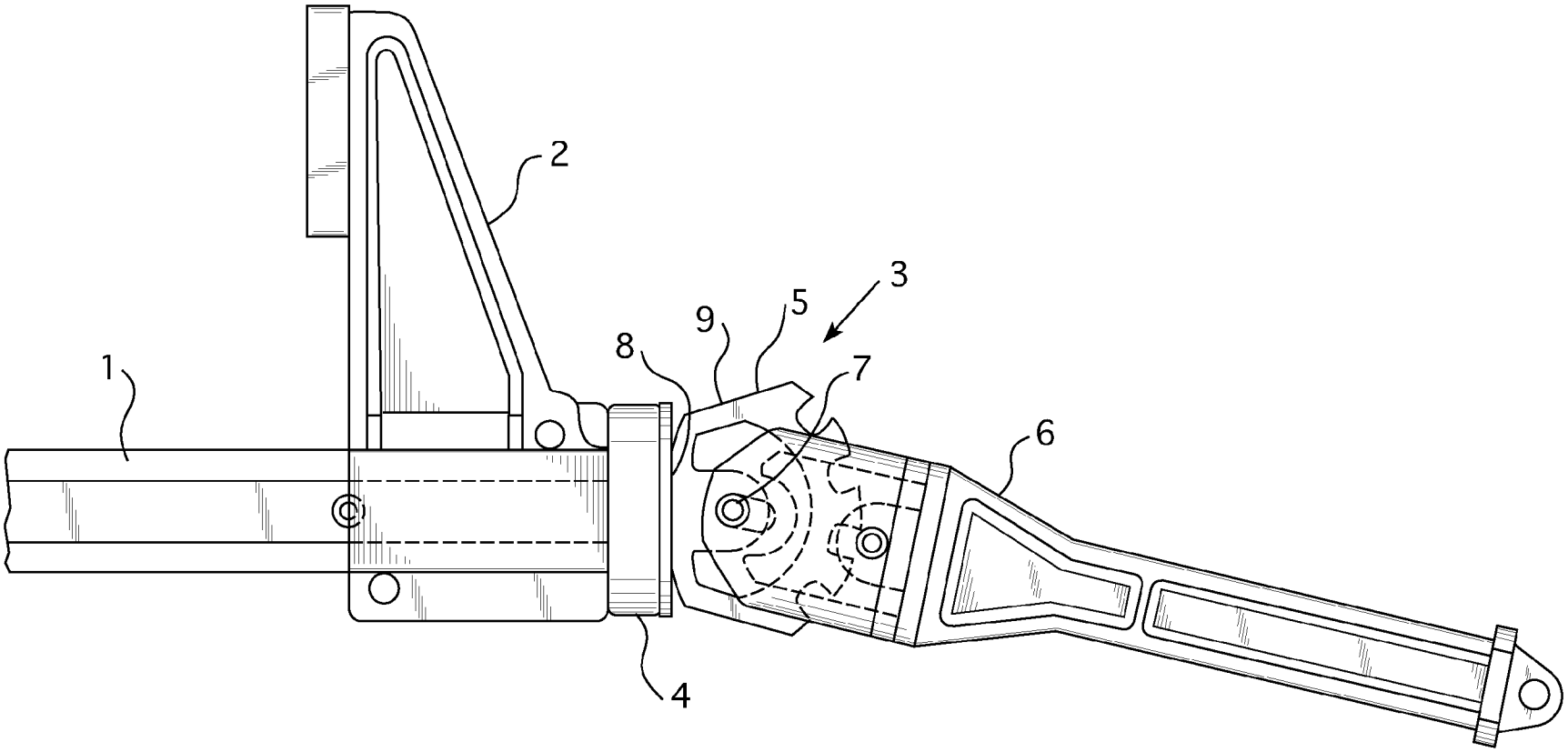
FIG. 1 Prior Art
FIG. 1 is a side view of a prior art sliding clamp with a clamp assembly in a first position.
Figure 2:
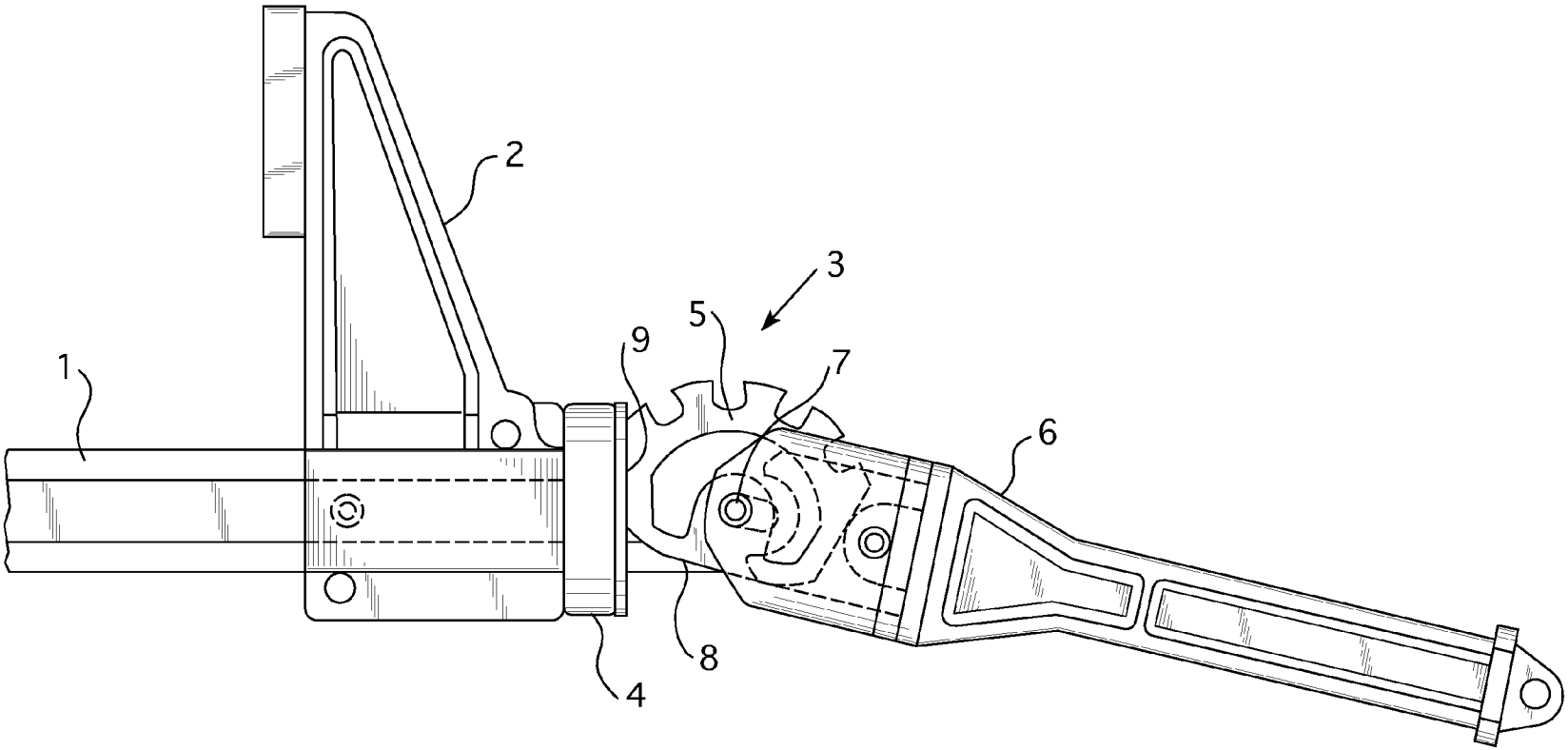
FIG. 2 Prior Art
FIG. 2 is a side view of a prior art sliding clamp with a clamp assembly in a second position.
Figure 3:
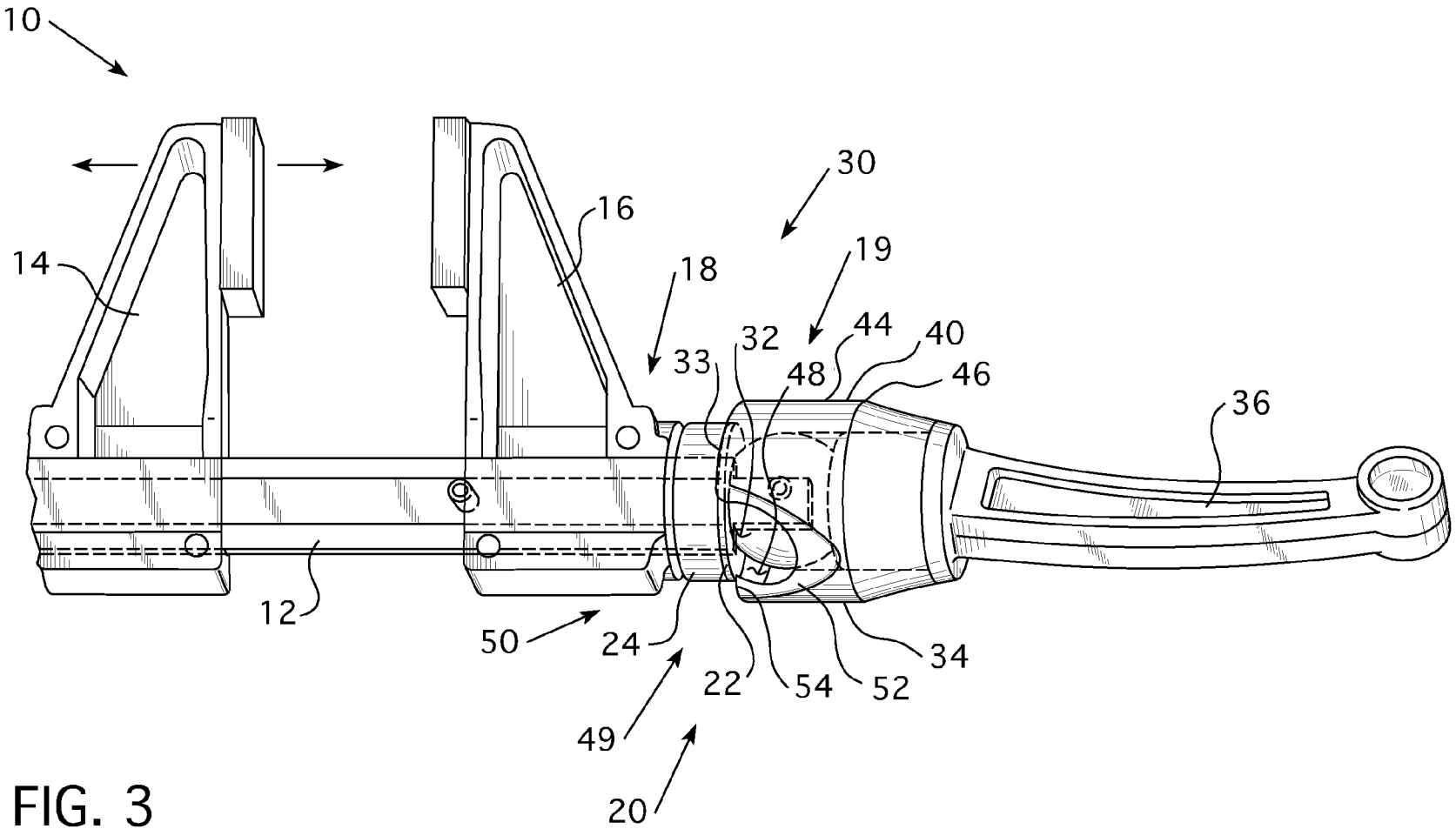
FIG. 3 is a side view of a sliding clamp according to the present invention with a clamp assembly in a first position.
Figure 4:
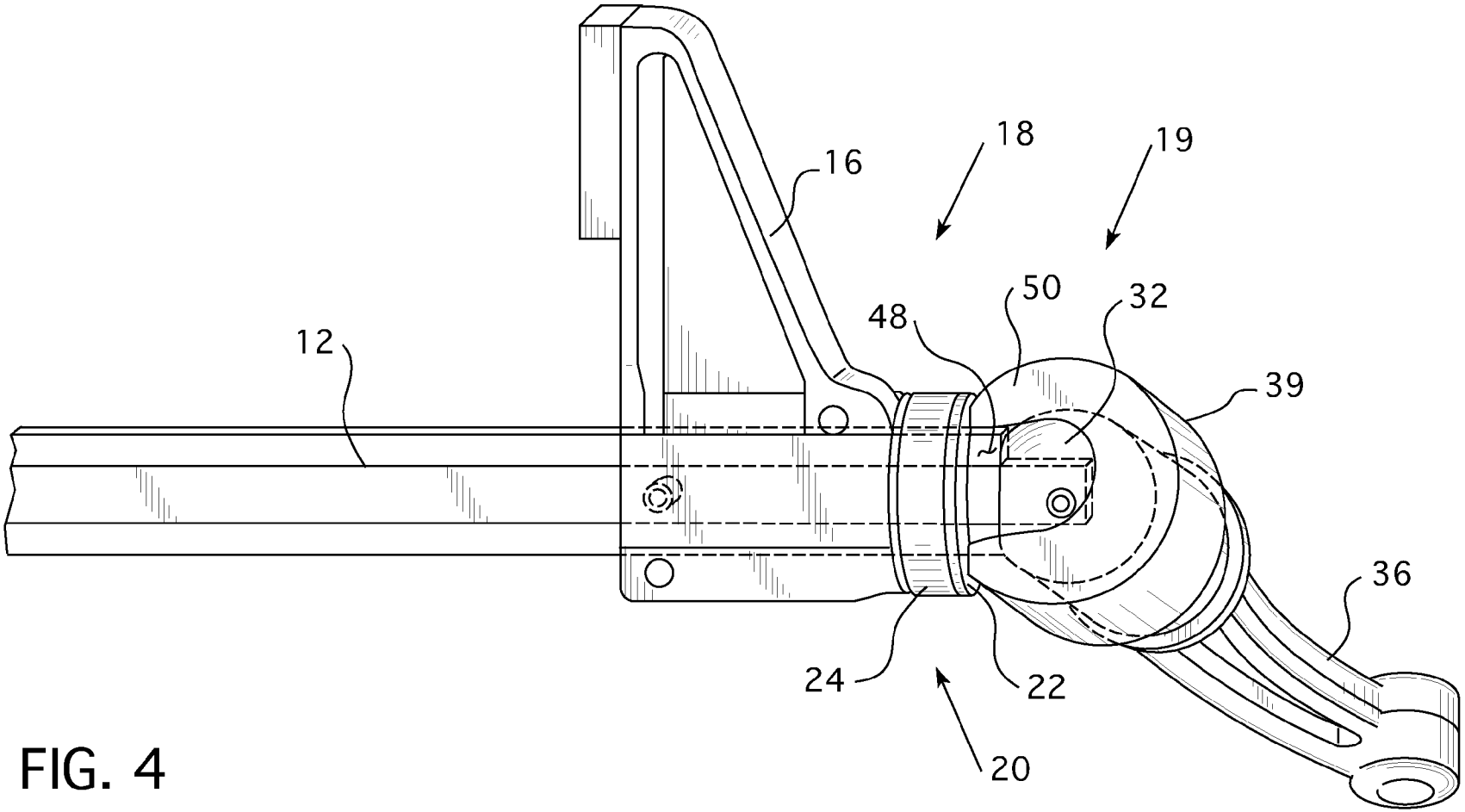
FIG. 4 is a side view of a sliding clamp according to the present invention with a clamp assembly in a second position and the cam actuator in a first orientation.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, "rotatably fixed" means that two components are coupled so as to move as one and maintain a generally constant position relative to each other, however the components may rotate relative to each other. For example, a bicycle tire is "rotatably fixed" to the bicycle frame; while the tire may rotate, the tire still moves with, and maintains a generally constant position relative to, the frame.

As shown in FIG. 3-6, a sliding clamp 10 includes an elongated bar 12, a sliding jaw assembly 14 (FIG. 3), a stationary jaw assembly 16, and a clamp assembly 30. The sliding jaw assembly 16 is slidably disposed on the bar 12 and may move longitudinally thereon. As is known in the art, the sliding jaw assembly 16 includes a locking assembly (not shown) structured to limit the direction of travel of the sliding jaw assembly 16. That is, when the locking assembly is engaged, the sliding jaw assembly 16 may not be moved away from the stationary jaw assembly 16. The bar has a first end 18 and a first end distal tip 19. It is noted that the bar first end distal tip 19 is, preferably, an extension from the bar 12 having a smaller cross-sectional area than the bar 12.

The stationary jaw assembly 16 is coupled to the bar 12 at the bar first end 18 adjacent to the distal tip 19. The stationary jaw assembly 16 is structured to have a limited longitudinal motion relative to the bar 12. That is, the word "stationary" is not used in a strict sense, but rather indicates that the stationary jaw assembly 16 has a very limited range of motion relative to the sliding jaw assembly 14. The stationary jaw assembly 16 moves between a first position, wherein the stationary jaw assembly 16 is closer to the distal tip 19, and a second position, wherein the stationary jaw assembly 16 is further from the distal tip 19. The stationary jaw assembly 16 includes a cam follower 20. The cam follower 20 preferably includes a rigid member 22 and a resilient member 24. The cam follower rigid member 22 is, preferably, disposed immediately adjacent to the first end distal tip 19. The stationary jaw assembly 16 moves in response to actuation of the clamp assembly 30, as described below. Thus, a user may position an object(s) between the sliding jaw assembly 14 and the stationary jaw assembly 16, then slide the sliding jaw assembly 14 toward the stationary jaw assembly 16. At this point, the user may apply manual pressure to bias the sliding jaw assembly 14 against the object, thereby loosely holding the object between the jaw assemblies 14, 16. However, the object will not be securely clamped until the clamp assembly 30 is actuated.

The clamp assembly 30 includes a ball 32, a cam member 34, and a cam actuator 36. The ball 32 is substantially spherical and is coupled to the bar first end distal tip 19. The ball 32 may have a flat 33 disposed immediately adjacent to the bar 12. The cam member 34 has a generally cylindrical body 40 with a first axial surface 42, a radial sidewall 44, a second axial surface 46, and a slot 48. Within the cam member body 40 is a ball socket 49. The first axial surface 42 is generally flat and acts as a first flat surface 50. The radial sidewall 44 also includes a flat portion that is a second flat surface 52. The second flat surface 52 extends to the cam member first axial surface 42. Thus, there is an interface of the first flat surface 50 and the second flat surface 52. Preferably, the interface of the first flat surface 50 and the second flat surface 52 is rounded and acts as a transition surface 54 (FIG. 5) between the first flat surface 50 and the second flat surface 52. The slot 48 extends over the first flat surface 50 and the second flat surface 52, as well as the transition surface 54. That is, the first flat surface 50, the second flat surface 52, and the transition surface 54 are bifurcated, or substantially bifurcated, by the slot 48. The slot 48 extends into the ball socket 49. That is, the slot has a sufficient depth to be contiguous with the ball socket 49. The slot 48 is sized to be disposed around the bar first end 18. The cam actuator 36 is, preferably, an elongated handle 60. The cam actuator 36 is coupled, and preferably fixed, to the cam member body second axial surface 46. Further, the cam actuator 36, preferably, extends in a direction parallel to the longitudinal axis of the cam member 34.

The clamp assembly 30 is assembled as follows. As noted above, the ball 32 is coupled, and preferably fixed or rotatably fixed, to the bar first end distal tip 19. Thus, the ball 32 is immediately adjacent to, and may contact, the cam follower rigid member 22. Preferably, the ball flat 33 is in contact with the cam follower rigid member 22 when the cam member 34 is in the first position, as described below. The ball 32 is further disposed, and trapped within, in the cam member ball socket 49. The ball 32 partially protrudes into the slot 48. The ball-and-socket coupling of the ball 32 and the cam member 34 creates a rotatable and pivotal coupling. That is, the cam member 34 may rotate and pivot relative to the ball 32, but the cam member 34 does not move axially or laterally relative to the ball 32. The first flat surface 50 is disposed at a first distance from a plane parallel thereto that passes through the center of the ball 32. The second flat surface 52 is disposed at a second distance from a plane parallel thereto that passes through the center of the ball 32. That is, in general terms, the first flat surface 50 is closer to the ball 32 than the second flat surface 52.

The clamp assembly 30 operates as follows. The cam member 34 moves between first and second operational positions. In the first operational position, the first flat surface 50 engages the cam follower rigid member 22 and, preferably, the cam actuator 36 extends in a direction substantially along, or parallel to, the longitudinal axis of the bar 12. In this position, the cam member 34 does not operatively engage, that is, apply more than an original bias to, the cam follower rigid member 22. Preferably, there is a slight bias between the cam member 34 and the cam follower rigid member 22. This slight bias will hold the cam member 34 in the first position. That is, without a slight bias, the weight of the cam actuator 36 may cause the cam member 34 to move into an undesirable transitional position. When the clamp assembly 30 is in the first operational position, the stationary jaw assembly 16 is in the first position.

In the second operation position, the cam member 34 is pivoted so that the second flat surface 52 engages the cam follower rigid member 22 and, preferably, the cam actuator 36 extends in a direction substantially perpendicular to the longitudinal axis of the bar 12. In this position, the cam member 34 operatively engages, that is, applies more than an original bias to, the cam follower rigid member 22. The bias created by the cam member 34 causes the stationary jaw assembly 16 to shift away from the bar first end distal tip 19. That is, when the clamp assembly 30 is in the second operational position, the stationary jaw assembly 16 is in the second position.

Figure 5:
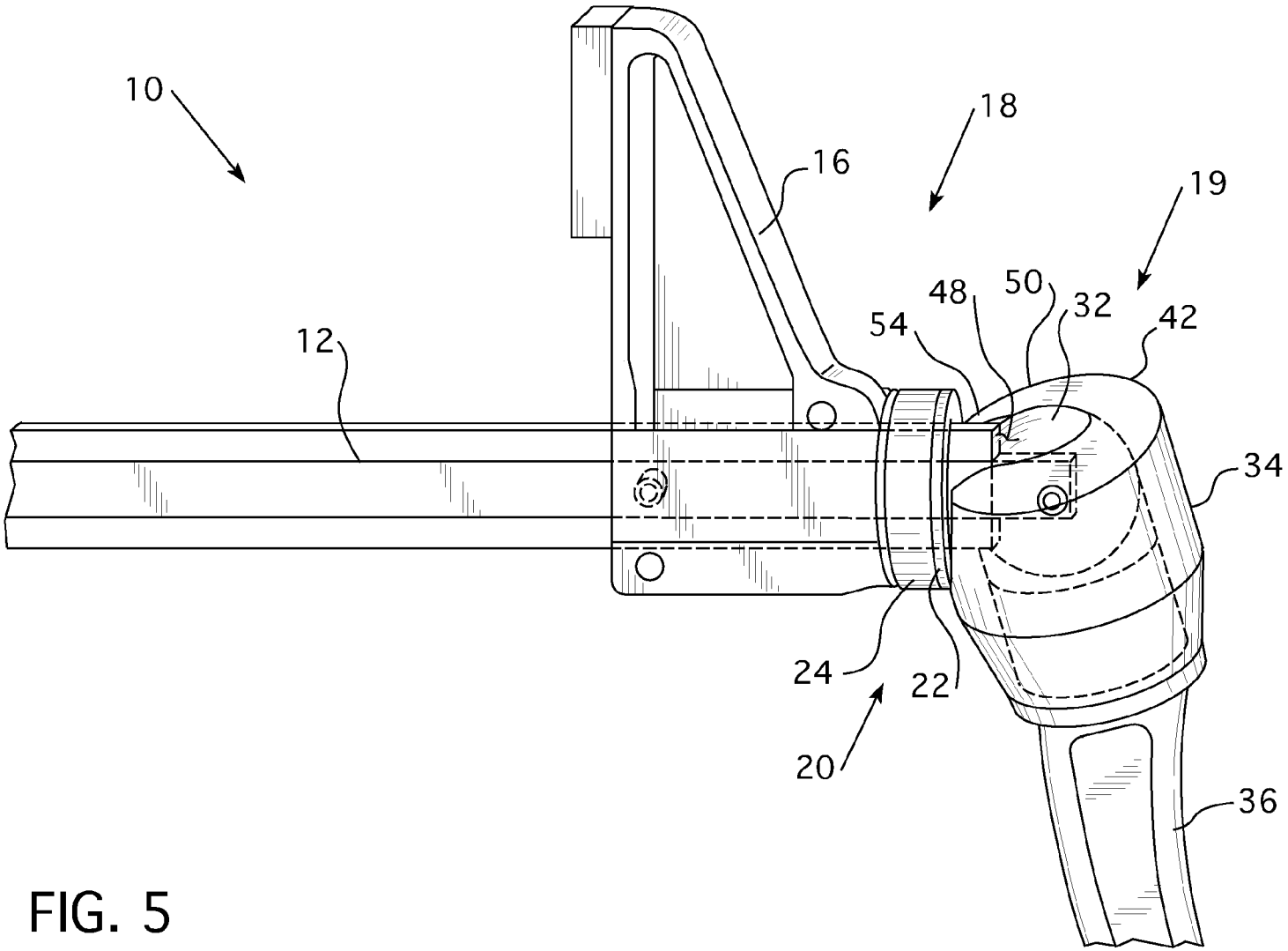
FIG. 5 is a side view of a sliding clamp according to the present invention with a clamp assembly in a second position and the cam actuator in a second orientation.

During the transition from the first and second operational positions, the transition surface 54 engages the cam follower rigid member 22. Further, as described above, as the stationary jaw assembly 16 is shifting into the second position, the stationary jaw assembly 16 is moving away from the bar first end distal tip 19. This action exposes a portion of the bar first end 18. The exposed portion of the bar first end 18 extends through the slot 48, as shown in FIG. 5.

Figure 6:
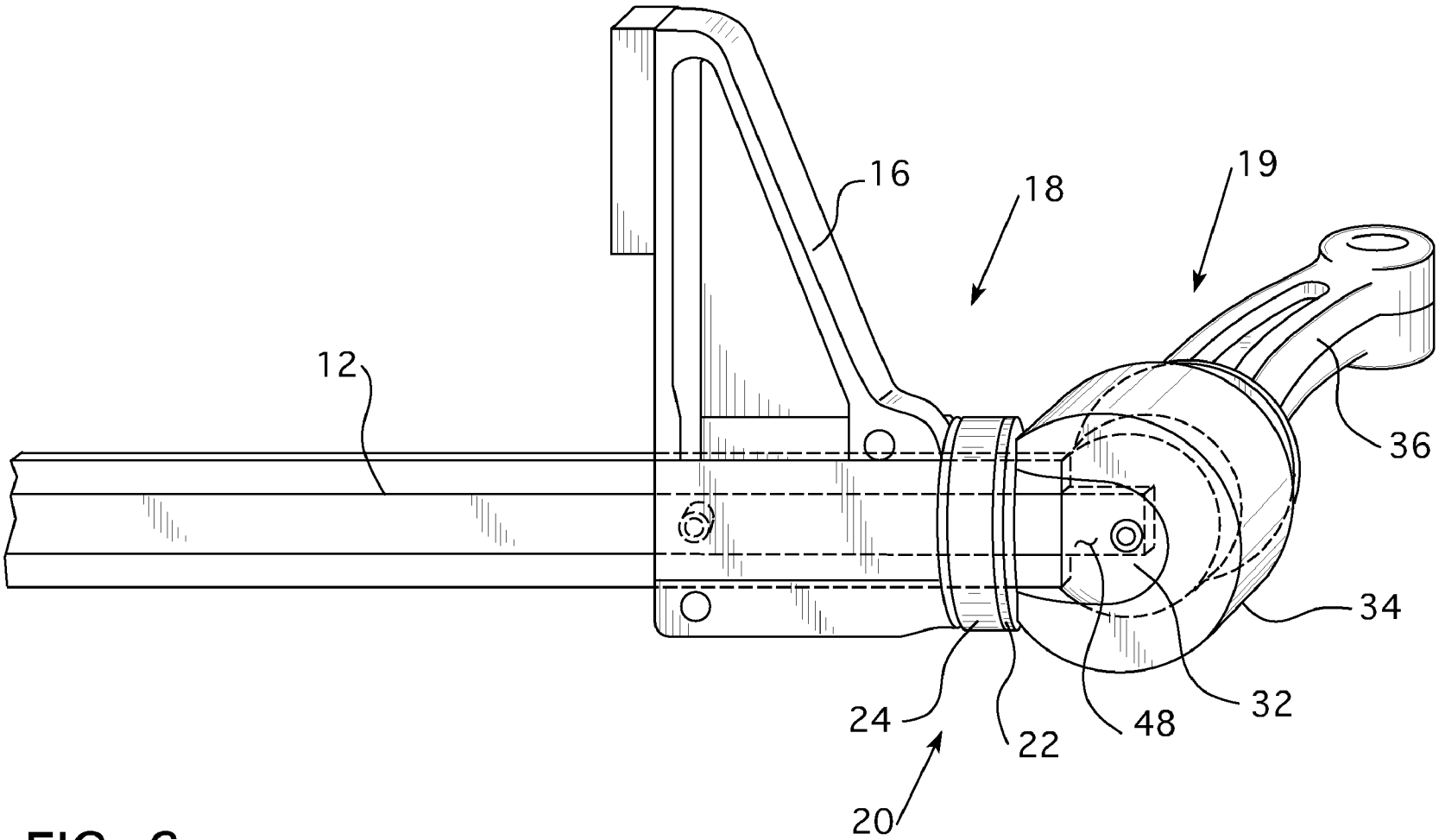
FIG. 6 is a side view of a sliding clamp according to the present invention with a clamp assembly in a second position and the cam actuator in a third orientation.

It is noted that the cam member 34 is free to rotate about the ball 32 when the cam member 34 is in either the first or second operational positions. Thus, the cam member 34 may move into an infinite number of positions. This is useful when the cam actuator 36 extends into a space a user needs to occupy or have a tool or other object occupy. For example, if the cam member 34 was only able to pivot in a vertical plane, in a manner similar to the prior art shown in FIG. 1, and if the bar 12 is disposed close to a workbench (not shown), when the user attempts to move the cam actuator 36 straight down, the cam actuator 36 may contact the workbench, thereby preventing the cam member 34 and stationary jaw assembly 16 from moving into their respective second positions. However, as shown in FIGS. 5 and 6, with the clamp assembly 30 disclosed herein, a user is able to rotate the cam member 34 and cam actuator 36 about the axis of the bar 12 into a position where the cam actuator 36 would not contact the workbench when moved into the second position. That is, the user could rotate the clamp assembly 30 so that the cam actuator 36 moves in a horizontal plane.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A clamp assembly for a sliding clamp, said sliding clamp having an elongated bar, a sliding jaw assembly, a stationary jaw assembly, said bar having a first end and a first end distal tip, said sliding jaw assembly slidably disposed on said bar, said stationary jaw assembly coupled to said bar adjacent said first end, said clamp assembly comprising:

a substantially spherical ball coupled to said bar first end distal tip;

a cam member having a ball shaped socket, said cam member structured to shift said stationary jaw assembly toward said sliding jaw assembly;

said cam member coupled to said ball, thereby forming a rotatable and pivotal ball-and-socket coupling;

said cam member has a generally cylindrical body with a first axial surface, a sidewall, and a second axial surface;

said first axial surface being a first flat surface;

said sidewall having a flat portion that is a second flat surface;

a transition surface extending between said first flat surface and said second flat surface; and wherein said cam member is structured to move between a first operational position, wherein said first flat surface engages said stationary jaw assembly, and a second operation position, wherein said second flat surface engages said stationary jaw assembly.

2. A clamp assembly according to claim 1 wherein:

said first flat surface is disposed at a first distance from a plane parallel thereto that passes through the center of said ball;

said second flat surface is disposed at a second distance from a plane parallel thereto that passes through the center of said ball; and wherein said first distance is less than said second distance.

3. A clamp assembly according to claim 2 wherein said cam member includes a slot extending over said first flat surface, said transition surface, and said second flat surface, said slot sized to be dispose about said bar first end, and said slot having a sufficient depth to be contiguous with said ball socket.

4. A clamp assembly for a sliding clamp, said sliding having an elongated bar, a sliding jaw assembly, a stationary jaw assembly, said bar having a first end and a first end distal tip, said sliding jaw assembly slidably disposed on said bar, said stationary jaw assembly coupled to said bar adjacent said first end, said clamp assembly comprising:

a substantially spherical ball coupled to said bar first end distal tip;

a cam member having a ball shaped socket, said cam member structured to shift said stationary jaw assembly toward said sliding jaw assembly;

a cam actuator coupled to said cam member;

said cam member coupled to said ball thereby forming a rotatable and pivotal ball-and-socket coupling;

said cam member has a generally cylindrical body with a first axial surface, a sidewall, and a second axial surface;

said first axial surface being a first flat surface;

said sidewall having a flat portion that is a second flat surface;

a transition surface extending between said first flat surface and said second flat surface; and wherein said cam member is structured to move between a first operational position, wherein said first flat surface engages said stationary jaw assembly, and a second operation position, wherein said second flat surface engages said stationary jaw assembly.

5. A clamp assembly according to claim 4 wherein:

said first flat surface is disposed at a first distance from a plane parallel thereto that passes through the center of said ball;

said second flat surface is disposed at a second distance from a plane parallel thereto that passes through the center of said ball; and wherein said first distance is less than said second distance.

6. A clamp assembly according to claim 5 wherein said cam member includes a slot extending over said first flat surface, said transition surface, and said second flat surface, said slot sized to be dispose about said bar first end, and said slot having a sufficient depth to be contiguous with said ball socket.

7. A clamp assembly according to claim 6 wherein said cam actuator is coupled to said second axial surface.

8. A clamp assembly according to claim 4 wherein said cam actuator is coupled to said second axial surface.

9. A sliding clamp comprising:

an elongated bar, said bar having a first end and a first end distal tip;

a sliding jaw assembly, said sliding jaw assembly slidably disposed on said bar;

a stationary jaw assembly, said stationary jaw assembly coupled to said bar adjacent said first end, said stationary jaw assembly structured to move between a first position, wherein said stationary jaw assembly is closer to said bar first end distal tip, and a second position, wherein said stationary jaw assembly is further from said bar first end distal tip;

a clamp assembly having a substantially spherical ball and a cam member;

said ball coupled to said bar first end distal tip;

said cam member having a ball shaped socket;

said cam member coupled to said ball thereby forming a rotatable and pivotal ball-and-socket coupling;

said cam member structured to shift said stationary jaw assembly into said stationary jaw assembly second position;

said cam member has a generally cylindrical body with a first axial surface, a sidewall, and a second axial surface;

said first axial surface being a first flat surface;

said sidewall having a flat portion that is a second flat surface;

a transition surface extending between said first flat surface and said second flat surface;

wherein said cam member is structured to move between a first operational position, wherein said first flat surface engages said stationary jaw assembly, and a second operation position, wherein said second flat surface engages said stationary jaw assembly; and wherein, when said cam member is in said cam member first position, said stationary jaw assembly is in said stationary jaw assembly first position, and, when said cam member second position, said stationary jaw assembly is in said stationary jaw assembly second position.

10. A sliding clamp according to claim 9 wherein:

said first flat surface is disposed at a first distance from a plane parallel thereto that passes through the center of said ball;

said second flat surface is disposed at a second distance from a plane parallel thereto that passes through the center of said ball; and wherein said first distance is less than said second distance.

11. A sliding clamp according to claim 10 wherein said cam member includes a slot extending over said first flat surface, said transition surface, and said second flat surface, said slot sized to be dispose about said bar first end, and said slot having a sufficient depth to be contiguous with said ball socket.

12. A sliding clamp comprising:

an elongated bar, said bar having a first end and a first end distal tip;

a sliding jaw assembly, said sliding jaw assembly slidably disposed on said bar;

a stationary jaw assembly, said stationary jaw assembly coupled to said bar adjacent said first end, said stationary jaw assembly structured to move between a first position, wherein said stationary jaw assembly is closer to said bar first end distal tip, and a second position, wherein said stationary jaw assembly is further from said bar first end distal tip;

a clamp assembly having a substantially spherical ball and a cam member;

said ball coupled to said bar first end distal tip;

said cam member having a ball shaped socket;

a cam actuator coupled to said cam member;

said cam member coupled to said ball thereby forming a rotatable and pivotal ball-and-socket coupling;

said cam member structured to shift said stationary jaw assembly into said stationary jaw assembly second position;

said cam member has a generally cylindrical body with a first axial surface, a sidewall, and a second axial surface;

said first axial surface being a first flat surface;

said sidewall having a flat portion that is a second flat surface;

a transition surface extending between said first flat surface and said second flat surface;

wherein said cam member is structured to move between a first operational position, wherein said first flat surface engages said stationary jaw assembly, and a second operation position, wherein said second flat surface engages said stationary jaw assembly; and wherein, when said cam member is in said cam member first position, said stationary jaw assembly is in said stationary jaw assembly first position, and, when said cam member second position, said stationary jaw assembly is in said stationary jaw assembly second position.

13. A sliding clamp according to claim 12 wherein:

said first flat surface is disposed at a first distance from a plane parallel thereto that passes through the center of said ball;

said second flat surface is disposed at a second distance from a plane parallel thereto that passes through the center of said ball; and wherein said first distance is less than said second distance.

14. A sliding clamp according to claim 13 wherein said cam member includes a slot extending over said first flat surface, said transition surface, and said second flat surface, said slot sized to be dispose about said bar first end, and said slot having a sufficient depth to be contiguous with said ball socket.

15. A sliding clamp according to claim 14 wherein said cam actuator is coupled to said second axial surface.

16. A sliding clamp according to claim 12 wherein said cam actuator is coupled to said second axial surface.

* * * * *

UNITED STATES PATENT AND TRADEMARK OFFICE

CERTIFICATE OF CORRECTION

PATENT NO. : 8,038,135 B2
APPLICATION NO. : 12/116353
DATED : October 18, 2011
INVENTOR(S) : Charles M. Phillips, Sr. et al.

It is certified that error appears in the above-identified patent and that said Letters Patent is hereby corrected as shown below:

Column 3, line 25, “FIG. 3-6” should read --FIGS. 3-6--.
Column 3, line 66, “a flat 33” should read --a ball flat 33--.
Column 4, line 31, “within in” should read --within--.
Column 4, line 60, “operation position,” should read --operational position--.
Column 5, line 66, “operation position” should read --operational position--.
Column 6, line 12, claim 3, “dispose” should read --disposed--.
Column 6, line 15, claim 4, “said sliding” should read --said sliding clamp--.
Column 6, line 52, claim 6, “dispose” should read --disposed--.
Column 7, line 23, claim 9, “operation position” should read --operational position--.
Column 7, line 28, claim 9, “cam member second position” should read --said cam member is in said second position--.
Column 7, line 41, claim 11, “dispose” should read --disposed--.
Column 8, line 29, claim 13, “cam member second position” should read --said cam member is in said second position--.
Column 8, line 43, claim 14, “dispose” should read --disposed--.

Signed and Sealed this
Tenth Day of April, 2012

David J. Kappos

David J. Kappos
*Director of the United States Patent and Trademark Office*